US007919160B2

(12) United States Patent
Rivoltella

(10) Patent No.: US 7,919,160 B2
(45) Date of Patent: Apr. 5, 2011

(54) COMPOSITE PACKAGING MATERIAL HAVING A BASE LAYER OF PAPER AND AN ATTACHED ADDITIONAL LAYER OR TUBULAR SLEEVE ENVELOPE OF PLASTIC MATERIAL, PARTICULARLY FOR FOOD PRODUCTS, AND METHOD FOR OBTAINING IT

(75) Inventor: Luigi Rivoltella, S. Giovanni Reatino (IT)

(73) Assignee: Bigpaper America, Inc., Ontario (CA)

( * ) Notice: Subject to any disclaimer, the term of this patent is extended or adjusted under 35 U.S.C. 154(b) by 201 days.

(21) Appl. No.: 10/830,314

(22) Filed: Apr. 23, 2004

(65) Prior Publication Data

US 2004/0197511 A1 Oct. 7, 2004

Related U.S. Application Data

(60) Division of application No. 09/739,663, filed on Dec. 20, 2000, now Pat. No. 6,843,371, which is a continuation-in-part of application No. 09/613,810, filed on Jul. 11, 2000, now abandoned.

(30) Foreign Application Priority Data

Jul. 12, 1999 (IT) ..... RM990158 U

(51) Int. Cl.

| | |
|---|---|
| ***B32B 1/02*** | (2006.01) |
| ***B32B 1/08*** | (2006.01) |
| ***B32B 29/00*** | (2006.01) |
| *B32B 29/08* | (2006.01) |

(52) U.S. Cl. ..... 428/34.7; 428/34.1; 428/34.2; 428/35.7; 428/35.9; 428/36.9

(58) Field of Classification Search ..... 206/45.33; 383/5, 61; 428/34.1, 35.7, 36.9, 34.2, 34.7, 428/35.9

See application file for complete search history.

(56) References Cited

U.S. PATENT DOCUMENTS

| | | | | |
|---|---|---|---|---|
| 2,114,625 | A * | 4/1938 | Bergstein | 493/197 |
| 2,127,029 | A * | 8/1938 | Hermanson | 229/87.08 |
| 2,333,943 | A * | 11/1943 | Levkoff | 229/162.1 |
| 2,553,923 | A * | 5/1951 | Lambert | 242/160.1 |
| 2,987,402 | A * | 6/1961 | Dold | 426/106 |
| 3,515,333 | A * | 6/1970 | Kotkas et al. | 206/395 |
| 3,741,778 | A * | 6/1973 | Rowe | 426/107 |

(Continued)

FOREIGN PATENT DOCUMENTS

EP 0 685 407 A1 12/1995

(Continued)

OTHER PUBLICATIONS

International Search Report dated Nov. 2, 2000.

*Primary Examiner* — Marc A Patterson

(74) *Attorney, Agent, or Firm* — Smith, Gambrell & Russell, LLP

(57) ABSTRACT

A composite double component packaging material, particularly suited for food products, includes a first component, having a base sheet of paper material, upon which a second component formed from a tubular sleeve of a thin film of plastic material is adhered. This packaging material is of a type approved for use with food products. The sleeve member can be longitudinally cut at any suitable position to provide one or two free foldable flaps.

10 Claims, 2 Drawing Sheets

U.S. PATENT DOCUMENTS 3,764,002 A * 10/1973 Spiegel et al. ..... 206/466
3,964,669 A * 6/1976 Sontag et al. ..... 220/62.13
4,483,018 A * 11/1984 Whelan ..... 383/5
4,589,553 A 5/1986 Ferrero
5,180,894 A * 1/1993 Quick et al. ..... 219/730
5,405,198 A * 4/1995 Garrett ..... 383/205
6,270,873 B1 * 8/2001 Darnett ..... 428/76
6,335,042 B1 * 1/2002 Money ..... 426/106

FOREIGN PATENT DOCUMENTS

FR 2 513 219 3/1983
GB 2 273 279 A 6/1994

* cited by examiner

COMPOSITE PACKAGING MATERIAL HAVING A BASE LAYER OF PAPER AND AN ATTACHED ADDITIONAL LAYER OR TUBULAR SLEEVE ENVELOPE OF PLASTIC MATERIAL, PARTICULARLY FOR FOOD PRODUCTS, AND METHOD FOR OBTAINING IT

RELATED APPLICATION DATA

This application is a division of application Ser. No. 09/739,663, filed Dec. 20, 2000 now U.S. Pat. No. 6,843,371, which is a continuation-in-part based on U.S. patent application Ser. No. 09/613,810, filed Jul. 11, 2000 now abandoned. This application further claims priority under 35 U.S.C. Section 119 based on Italian Patent Appln. No. RM99 U 000158, filed Jul. 12, 1999. These applications are entirely incorporated herein by reference.

BACKGROUND OF THE INVENTION

This invention broadly relates to packaging materials, and more particularly, it concerns a composite, double component, paper based packaging material, especially useful for packaging food products.

Although this specification should be understood as requiring no restrictive limitations on the use of the disclosed packaging materials, materials produced according to the invention have been found to be particularly useful in the field of packaging materials for the retail sale of food products, particularly single piece and discrete products, such as bacon, cheese, meats, dairy products and like.

As is well known, as a consequence of established general practices, and in order to comply with the increasingly more restrictive and binding hygienical regulations, food products offered for retail sale to the public often are packaged in wrappings consisting of sheets of paper based material that are wrapped around the product. Packaging using paper based packaging material must fulfill well established hygiene and safety requirements. Therefore, it has been for a certain time, and presently it is still, an accepted general practice to use composite wrappings comprising a paper based sheet, intended not to contact the food product, together with a thin film of a plastic material, as a food wrapping material. Such a composite wrapping complies with the legal hygiene and use safety regulations and requirements.

Such wrappings, however, have at least one deficiency. In fact, when aiming at preventing the concerned food product from contacting the external paper based material during the wrapping operation (which very often entails a rolling of the paper based material together with the food product contained therein, which often consists of a number of thin wafers), it is a common practice to use a second sheet of plastic material to directly cover the concerned food product. In this manner, even if the packaging material is to be very tightly wrapped, the concerned food product is always insulated and separated from the external paper based layer.

Even if it is certainly efficient, this approach always entails use of two materials of different kinds, with the consequent problems of storage, inventory, separate housing compartments and like. Furthermore, the handling of the materials entails an increased risk of contamination of the surfaces contacting the concerned food product.

SUMMARY OF THE INVENTION

It is an object of this invention to improve this kind of packaging materials and to provide a composite double component packaging material that is easy to manufacture, easy to store, and easy to apply, while at the same time, providing better performance than that offered by conventional packagings, even the most recently developed ones. Furthermore, the second component of the double component packaging material is substantially realized as a sleeve member that is very versatile, so that, with simple operations and provisions, many variations can be obtained with many possible application possibilities.

This invention, therefore, relates to a composite double component packaging material, particularly useful for wrapping food products, which comprises a first component acting as a support paper base layer, upon which a second component is adhered. The second component comprises a tubular sleeve made from a thin film of a material hygienically acceptable for contact with food products. This tubular sleeve has a transversal size smaller than, equal to, or larger than the transversal size of the paper base layer, depending upon the application for which the product is intended.

Such a tubular sleeve enables that, once the product to be packaged is inserted into the tubular sleeve, the assembly can be rolled or folded while the base paper sheet is outwardly maintained, with a full and complete guarantee that, whichever rolling or folding operation is carried out, the packaged food product will only and exclusively contact the inner surface of the tubular sleeve, and it will never contact the external surface of the tubular sleeve. The food product is even less likely to contact any portion of the paper base sheet.

A sleeve member with an equal or preferably larger transversal dimension than that of the base layer enables one to obtain, by means of a simple longitudinal cutting operation of the sleeve material, a composite double-layer packaging material, comprising a first support layer having a second layer adhered thereto. The second layer comprises the thin film of the sleeve member described above, longitudinally cut with dimensions equal to or preferably larger than the dimensions of the first support layer, so as to form at least one foldable flap designed to be folded upon the food product laid upon the package and to be preferably overlapped upon itself.

Both components of the packaging material can be provided with one or more longitudinal weakness lines, for instance a nearly central weakness line, so as to make it possible to remove a half portion of the whole package and to thereby uncover only a portion of the packaged food product, for instance a hot dog to be consumed, while the other half portion of the package is maintained in place as a protective cover for the food product. Of course, the weakness lines may be located at any place on the composite packaging material. For instance, instead of centrally located, the weakness lines may be located at a laterally offset position.

It also is possible to provide a transversal welding on one end edge of the double component packaging material in order to obtain a bag like package.

BRIEF DESCRIPTION OF THE DRAWINGS

Further details and advantages of this invention will be apparent from the following detailed description with reference to the annexed drawings in which the preferred embodiments are shown by way of illustration and not by way of limitation.

In the drawings.

DETAILED DESCRIPTION OF THE INVENTION

Figure 1:
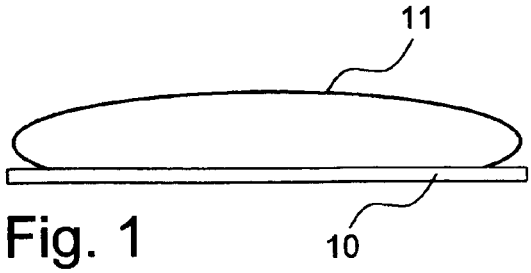
FIG. 1 is a cross-sectional view of a composite double component packaging sheet material according to this invention.

Referring now to FIG. 1 of the drawings, a first embodiment of this invention comprises a first component 10, comprising a base sheet of paper material, upon which a second component 11 formed as a tubular sleeve of a thin film of plastic material is applied. This second component 11 is a plastic material of a kind approved for use with food products. The tubular sleeve 11 may be made of polyethylene or a similar material, manufactured by conventional extrusion methods. It also may be adhered to the paper base sheet 10 by means of conventional methods and equipment, for instance by gluing.

In this first embodiment, a characterizing feature of the thin film tubular sleeve 11 is that, for convenience of use and functionality reasons, it has a transversal dimension not larger than the base sheet 10, and particularly it can be narrower than the base sheet 10, so as to leave a certain free edge on one or on both sides. Upon introducing the concerned food product into the sleeve, the product is retained in a covered and protected condition. The upper flap of the sleeve 11 performs the same function as that performed by a second separate overposed sheet of plastic material according to the present state of the art as described above.

Figure 2:
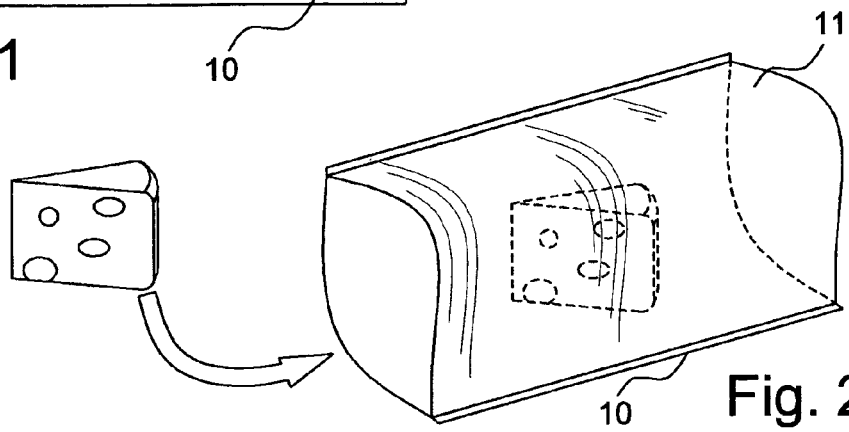
FIG. 2 is a perspective view of a composite double component packaging sheet material according to the invention with a tubular sleeve in a partially open condition, in order to show how the product is inserted therein.

Referring to FIG. 2 of the drawings, the initial step for use of the packaging material is shown, in which the upper flap of the tubular sleeve 11 is slightly lifted so that the food product can be introduced into the sleeve 11.

Figure 3:
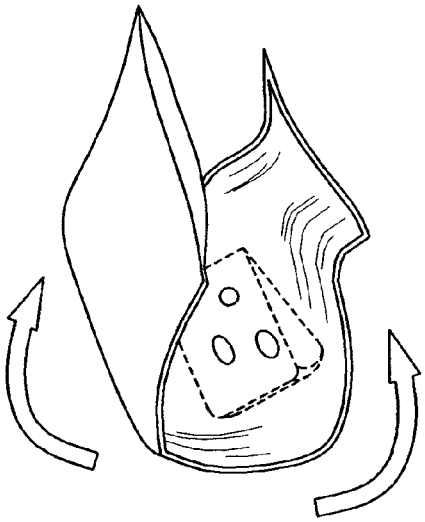
FIG. 3 is a perspective view of a package according to the invention containing a food product while it is being folded.

FIG. 3 shows the subsequent step for use in which the package is folded. The folding mode is self-explanatory, but it should be understood that the folding step can also be carried out as a rolling step. Additionally, such folding or rolling steps can also be performed in a different direction with respect to the illustrated one, without departing from the scope of this invention.

Figure 4:
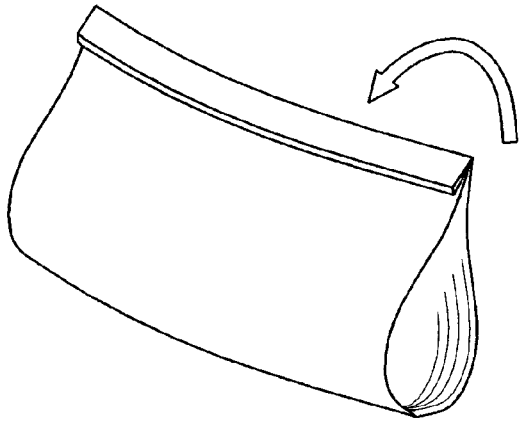
FIG. 4 shows the final stage of the folding sequence of the package of FIG. 3, in which the open flaps are hermetically sealed.
Figure 5:
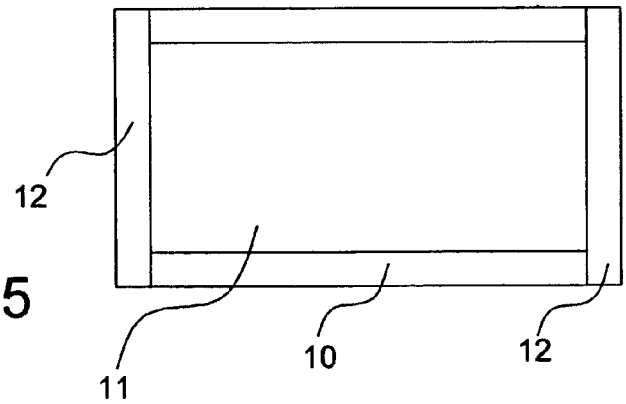
FIG. 5 is a plan top view of a different embodiment of the invention having two longitudinal flaps adapted to be glued.

By referring to FIGS. 4 and 5, it can be observed that the simplest procedure for hermetically closing the package provides that the longitudinal flaps be folded. In this respect, however, the possibility is to be mentioned for the tubular sleeve 11 to have a longitudinal dimension even smaller than the longitudinal dimension of the base sheet 10, so as to leave one or two free longitudinal edges 12 of the base sheet. Such free edges 12 can be provided with suitable glue stripes, for instance, a pressure responsive or sensitive adhesive, so as to make the hermetical closure operation of the package more immediate and certain, as illustrated in FIG. 4. Such pressure responsive or sensitive adhesive glue stripes may be adapted to be protected before use by detachable cover strips, so as to activate the gluing effect only at the desired time. Such adhesives and removable cover stripes are conventional and well known to those skilled in the adhesive arts.

As above mentioned, the adhesion between the base sheet 10 and the thin plastic material tubular sleeve 11 overlaid thereupon can be effected by means of any desired method and equipment. It is suggested, however, that the adhesion not extend to the whole contacting surfaces, so as to leave a not adherent peripheral edge designed to aid lifting of the upper flap of the sleeve 11.

The package according to this invention allows for a more prolonged storage of the food product contained therein. This package also has the advantage that it eliminates any possibility that the operator, for instance, an employee at a gastronomy bench, will inadvertently contact the inner surface of the packaging sleeve, thereby providing the possibility of handling the package as a whole with little or no risk of hygienic contamination. Furthermore, the extremely easy procedure to be followed for closing the package by a simple folding operation with possible optional adhesion of its longitudinal edges enables the consumer to re-use the package or, if desired, only its tubular sleeve for disposal of any resulting residuals.

Figure 6:
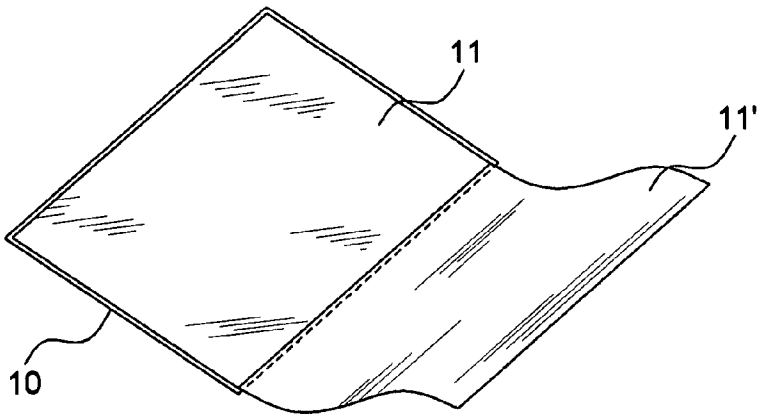
FIG. 6 is a perspective view of a composite double-layer packaging sheet material according to the invention, having an overlapping and foldable flap, obtained by longitudinally cutting the sleeve-like second component, the second component having a transversal dimension equal to the corresponding transversal dimension of the support paper base layer.

Referring to FIG. 6 of the drawings, a second embodiment of the invention can be observed. In this embodiment, which should not be construed as limiting or restricting the invention, the sleeve component 11 has a transversal dimension-equal to (or substantially equal to) the corresponding transversal dimension of the support base sheet 10, and the sleeve member 11 can be longitudinally cut or torn, at a lateral position, so as to form a free flap 11'. After the flap 11' has been opened and the food product has been laid on the double-layer portion of the packaging sheet (i.e., base sheet 10 and bottom sleeve component 11), the so formed free flap 11' is folded over and laid upon the food product. In this manner, the free flap 11' performs the same function as that performed by the second separate sheet of plastic material according to the state of the art described above.

Figure 7:
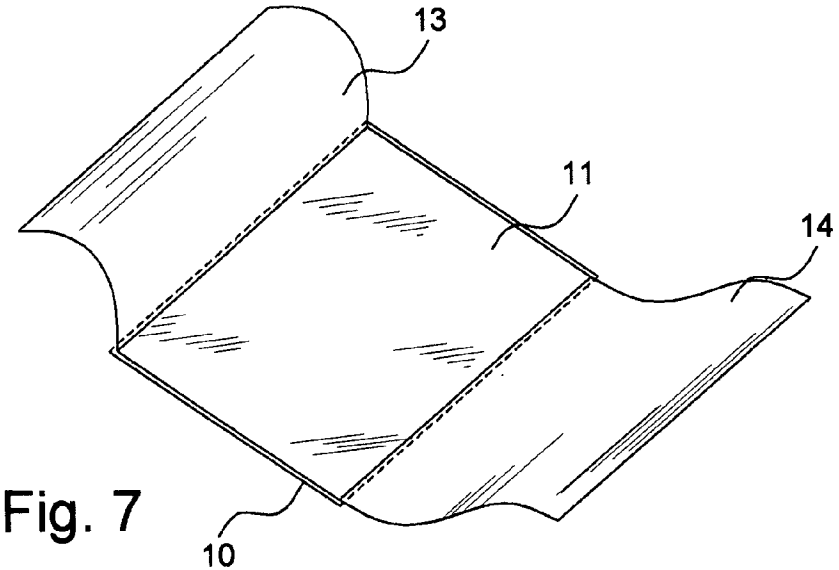
FIG. 7 is a perspective view of a composite double-layer packaging sheet material according to the invention having two foldable and overlapping flaps, obtained by longitudinally cutting the sleeve-like second component, the second component having dimensions larger than the corresponding dimensions of the support paper base layer.

Referring now to FIG. 7 of the drawings, a further embodiment of this invention is illustrated. This embodiment again comprises a first component acting as a support base sheet 10, with a sleeve like second component 11 having a transversal dimension much larger than the corresponding transversal dimension of the support base sheet 10. In this embodiment, however, the sleeve member 11 has been longitudinally cut or torn at about its central position, so as to form two free flaps 13 and 14. After the flaps 13 and 14 have been opened and the food product has been laid on the double-layer portion of the packaging sheet (i.e., on base sheet 10 and bottom sleeve component 11), the so formed free flaps 13 and 14 are folded over and laid upon the food product. In this manner, the free flaps 13 and 14 perform the same function as that performed by the second separate sheet of plastic material according to the state of the art described above. Depending on the dimensions of the sleeve like member 11, upon folding, the free flaps 13 and 14 may only be intermediately juxtaposed, or they can also slightly overlap one another in the intermediate area, so as to increase the coverage effect upon the food product. Of course, the longitudinal cut or tear in the sleeve member 11 can be made at any suitable location laterally away from the sleeve center, if desired.

Figure 8:
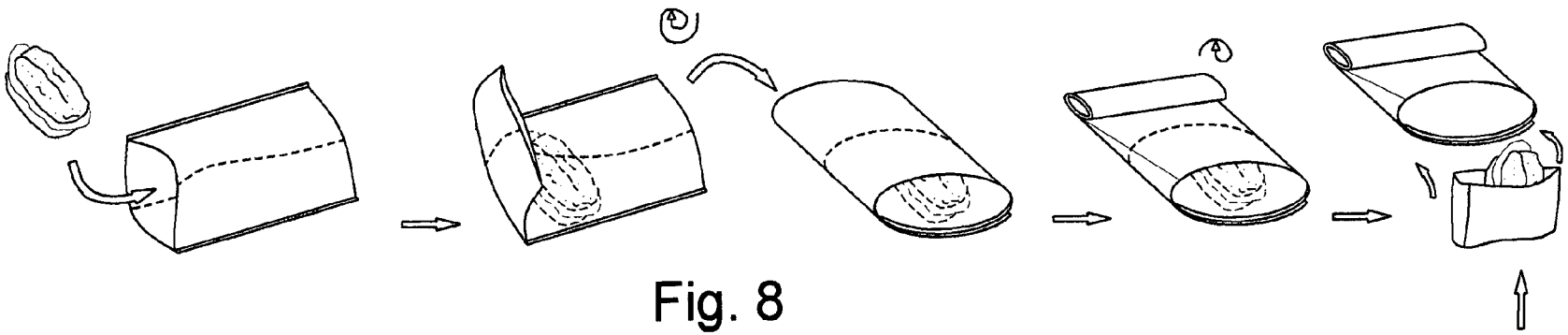
FIG. 8 shows a sequence of use of a package having both components longitudinally scored in order to wrap a consumable food product and adapted to divide the package into two separate half portions by a simple tearing operation.

FIG. 8 shows a sequence of use of a package according to this invention, in which a weakness line has been provided, for instance by scoring, in both components of the package. This embodiment has been found to be very useful for packaging food products intended for extemporaneous consumption, for instance, a hot dog or a piece of pizza. After the food product has been inserted into the package (first stage) and the package has been folded (second stage), rolled up (third stage), and possibly closed at its bottom edge (fourth stage), a half portion of the package can be torn off (fifth stage) at the illustrated scoring lines, so that the other half portion continues acting as a cover for the involved product and only the uncovered portion thereof is accessible for consumption. The remaining half portion of the package then acts like a pocket which enables the contents to be withdrawn by a pushing action exerted on the external side of the package, thereby avoiding any risk of soiling one's hands or contaminating the contents of the package.

It has already been mentioned, but it is now desired to underscore, that the two component package can be transversely welded at one end edge, so as to provide a bag like package.

As above mentioned, adhesion between the base sheet 10 and the thin plastic material film 11 overposed thereupon can be effected by means of any desired method and equipment. It is suggested, however, that the adhesion not extend over the entire contacting surfaces, so as to leave a not adherent peripheral edge designed to aid folding or lifting of the upper flap or flaps.

The preferred embodiments of this invention have been heretofore described, but it should be expressly understood that those skilled in the art can make changes and modifications to the details and to the material compositions, as well as to the thicknesses and the shapes of the packaging materials, without departing from the spirit and scope of this invention as defined in the annexed claims.

I claim:

1. A composite double component package, for containing a food product, said packaging material consisting essentially of:

a base sheet of a paper material having a first surface and a second surface, a singular tubular sleeve consisting of a thin plastic material having an inside and an outside and a first side portion and a second side portion, and an adhesive component adhering only the first side portion of the tubular sleeve to the base sheet such that the second side portion of the tubular sleeve is free from adherence to the base sheet, the tubular sleeve having open ends that receive a food product and locate the product in the inside of the tubular sleeve, wherein the plastic material is a material approved for containing food products, wherein said packaging material is foldable and rollable such that the base sheet rolls to surround the outside of the tubular sleeve and a food product received in the tubular sleeve, with substantially only the second surface of the base sheet exposed, and wherein the tubular sleeve has a transverse dimension smaller than a corresponding transverse dimension of the base sheet, so as to leave an edge on the base sheet that is not covered by the tubular sleeve.

2. A composite package according to claim 1, wherein adhesion between the base sheet and the tubular sleeve is provided such that less than their entire contacting surfaces are adhered to one another.

3. A composite package according to claim 2, wherein the tubular sleeve has a longitudinal dimension smaller than a corresponding longitudinal dimension of the base sheet, so as to leave at least one free longitudinal edge of the base sheet, wherein the at least one free longitudinal edge is provided with a glue stripe which forms a hermetically sealable closure for the package.

4. A composite package according to claim 3, wherein the glue stripe is a pressure responsive adhesive or a pressure sensitive adhesive.

5. A composite package according to claim 4, wherein the pressure responsive adhesive or pressure sensitive adhesive is covered by a detachable cover strip.

6. A composite package according to claim 1, wherein adhesion between the base sheet and the tubular sleeve extends to less than their entire contacting surfaces so as to leave at least one not adherent peripheral edge.

7. A composite double component package, for containing a food product, said package consisting essentially of:

a first component including a base sheet of a paper material having a first surface and a second surface, an adhesive, and a second component consisting of a tubular sleeve having a first side portion, a second side portion, an inside, and an outside, the first side portion of the tubular sleeve being adhered to the first surface of the first component by the adhesive, and the second side portion of the tubular sleeve being free from adherence to both surfaces of the first component, wherein the tubular sleeve consists of a thin film of plastic material with open ends, wherein the plastic material is a material approved for containing food products with a food product being introduced into the tubular sleeve through the open ends thereof whereby the product is located in the inside of the sleeve directly between the first side portion and the second side portion, wherein each of the first and second components is foldable and rollable such that said package is foldable and rollable and such that the base sheet rolls to surround the tubular sleeve and the food product received inside the tubular sleeve, with substantially only the second surface of the base sheet exposed, wherein the first component includes at least one longitudinal weakness line along which the first component can be torn, and the second component includes at least one correspondingly located longitudinal weakness line along which the second component can be torn, and wherein the tubular sleeve has a transverse dimension smaller than a corresponding transverse dimension of the base sheet, so as to leave an edge on the base sheet that is not covered by the tubular sleeve.

8. A composite package according to claim 7, wherein the longitudinal weakness lines of the first and second components are realized by scoring and are located at approximately a central lateral position.

9. A composite package according to claim 7, wherein the longitudinal weakness lines of the first and second components are realized by scoring and are located at a laterally offset position.

10. A composite package according to claim 1, wherein the double component packaging material is transversely welded at one end edge.

* * * * *